US008334448B2

(12) United States Patent
Onheiser

(10) Patent No.: US 8,334,448 B2
(45) Date of Patent: Dec. 18, 2012

(54) SUPPORT FOR PERCUSSION INSTRUMENT

(76) Inventor: Paul Albert Onheiser, Westminster, MD (US)

( * ) Notice: Subject to any disclaimer, the term of this patent is extended or adjusted under 35 U.S.C. 154(b) by 0 days.

(21) Appl. No.: 13/190,890

(22) Filed: Jul. 26, 2011

(65) Prior Publication Data

US 2012/0017747 A1 Jan. 26, 2012

Related U.S. Application Data

(60) Provisional application No. 61/367,628, filed on Jul. 26, 2010.

(51) Int. Cl.
*G10D 13/02* (2006.01)

(52) U.S. Cl. ..... 84/421

(58) Field of Classification Search ..... 84/421
See application file for complete search history.

(56) References Cited

U.S. PATENT DOCUMENTS

| | | | | | |
|---|---|---|---|---|---|
| 2,163,949 | A * | 6/1939 | Kiemle | 84/402 |
| 3,831,923 | A * | 8/1974 | Meldrum | 267/141 |
| 4,216,695 | A * | 8/1980 | Hoshino | 84/421 |
| 4,889,028 | A * | 12/1989 | Lombardi | 84/421 |
| 4,960,028 | A * | 10/1990 | Ramirez | 84/421 |
| 5,808,217 | A * | 9/1998 | Liao | 84/422.3 |
| 5,934,629 | A * | 8/1999 | Peritz | 248/177.1 |
| 6,239,343 | B1 * | 5/2001 | Hoshino | 84/422.3 |
| 6,858,788 | B2 * | 2/2005 | Liao | 84/422.3 |
| 6,930,233 | B2 * | 8/2005 | Hsieh | 84/422.3 |
| 6,940,006 | B2 * | 9/2005 | Takegawa | 84/327 |
| 7,394,009 | B2 * | 7/2008 | Judd | 84/421 |
| 7,479,593 | B1 * | 1/2009 | Townsend | 84/421 |
| 7,629,526 | B1 * | 12/2009 | Miyajima | 84/422.1 |
| 7,820,899 | B2 * | 10/2010 | Liao | 84/422.3 |
| 7,915,507 | B2 * | 3/2011 | Onheiser | 84/421 |
| 2004/0094016 | A1 * | 5/2004 | Hallerberg | 84/422.3 |
| 2004/0113339 | A1 * | 6/2004 | Masterson et al. | 267/153 |
| 2005/0120864 | A1 * | 6/2005 | Takegawa | 84/421 |
| 2007/0079687 | A1 * | 4/2007 | Hsieh | 84/421 |
| 2007/0120301 | A1 * | 5/2007 | Domen et al. | 267/152 |
| 2010/0294111 | A1 * | 11/2010 | Carraro | 84/421 |
| 2011/0265632 | A1 * | 11/2011 | Harrison et al. | 84/421 |
| 2012/0017747 | A1 * | 1/2012 | Onheiser | 84/421 |

* cited by examiner

*Primary Examiner* — David Warren
*Assistant Examiner* — Robert W Horn
(74) *Attorney, Agent, or Firm* — Edell, Shapiro & Finnan, LLC

(57) ABSTRACT

The present invention relates to a support for a percussion instrument and, in particular, to a cymbal support device. The device includes a body having a base section, an intermediate neck section, and a cap section. A bore extends through the body along body central axis. The cap section is configured to selectively tilt or flex when a predetermined amount of force is applied thereto. In operation, the support device is mounted on a cymbal support pole at the desired vertical position, and the cymbal is placed on the body such that it is supported by the cap. In use, as the cymbal is engaged by a percussionist, the cap flexes with the movement of the cymbal.

10 Claims, 7 Drawing Sheets

SUPPORT FOR PERCUSSION INSTRUMENT

CROSS REFERENCE TO RELATED APPLICATIONS

The present invention claims priority under 35 U.S.C. §119 (e) to provisional application No. 61/367,628, entitled "Cymbal Spacer Support" and filed on 26 Jul. 2010, the disclosure of which is hereby incorporated by reference in its entirety.

FIELD OF THE INVENTION

The present invention relates to a support for a percussion instrument and, in particular, a spacer for a cymbal.

BACKGROUND OF THE INVENTION

Cymbals are well known percussion devices usually played by a drummer. The best sound of a cymbal is a ringing sound or clear resonance; consequently, cymbals have been made with a bell-shape at the center point to assist in producing a ringing sound of high resonance. When mounting a cymbal on a stand, it is important to secure it in a manner that avoids the production of dead sound, as well as results in a sound having the desired resonance. Specifically, the cymbal should be mounted on the rod in a manner that prevents the mounting device from damping the vibrations of the cymbal when struck. In other words, the cymbal should be able to tilt or wobble when struck to the extent desired by the percussionist.

Stands for mounting cymbals include a rod or pole having a threaded section at its upper end that is inserted through a central aperture formed into the cymbal. The cymbal typically rests on an annular shoulder that may be formed as a diametrically widened section of the rod, and is secured to the rod by a fastener (such as a wing nut) that engages the threaded upper section of the rod. A cymbal support may be placed on the rod immediately below the cymbal. The support, e.g., a ring-shaped cushion of felt or similar material, helps to support the cymbal in the desired vertical position along the rod. These conventional cymbal supports suffer from several drawbacks. First, they possess an inconsistent contact surface, thus are unstable. Second, conventional supports wear over time, making the support ineffective at maintaining the vertical positioning of the cymbal. Third, conventional supports do not accommodate tilting of the cymbal, thus tend to dampen the vibration of the cymbal, diminishing sound quality.

Thus, it would be desirable to provide a support device for a cymbal that provides stable support while permitting unabated tilting of the cymbal to prevent dampening of cymbal sound.

SUMMARY OF THE INVENTION

The present invention relates to a support or spacer for a percussion instrument and, in particular, to a cymbal support device. The device includes a body having a base section, an intermediate neck section, and a cap section. A bore extends through the body along body central axis. The cap section is configured to selectively tilt or flex when a predetermined amount of force is applied thereto. In operation, the support device is mounted on a cymbal support pole at the desired vertical position, and the cymbal is placed on the body such that it is supported by the cap. In use, the device supports the cymbal in a desired vertical position along the cymbal support pole. As the cymbal is struck by a percussionist, the cap flexes with the tilt of the cymbal.

BRIEF DESCRIPTION OF THE DRAWINGS

Like reference numerals have been used to identify like elements throughout this disclosure.

DETAILED DESCRIPTION OF THE INVENTION

Figure 1A:
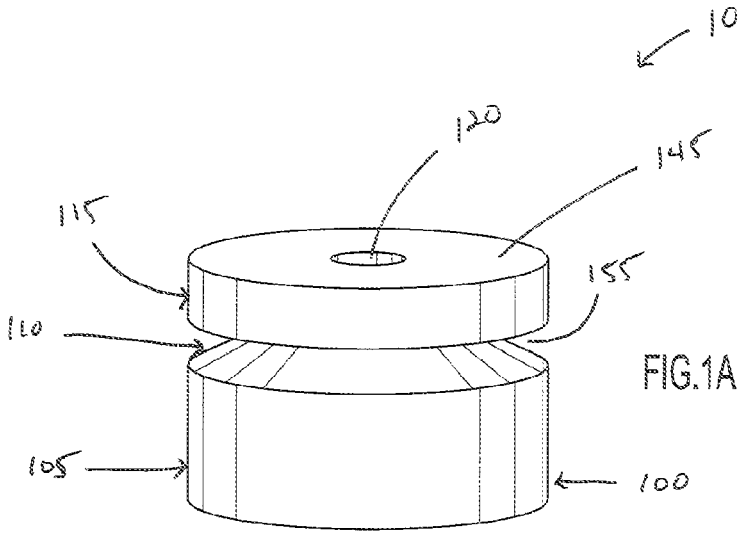
FIGS. 1A and 1B illustrate perspective views of a support device in accordance with an embodiment of the present invention.
Figure 1B:
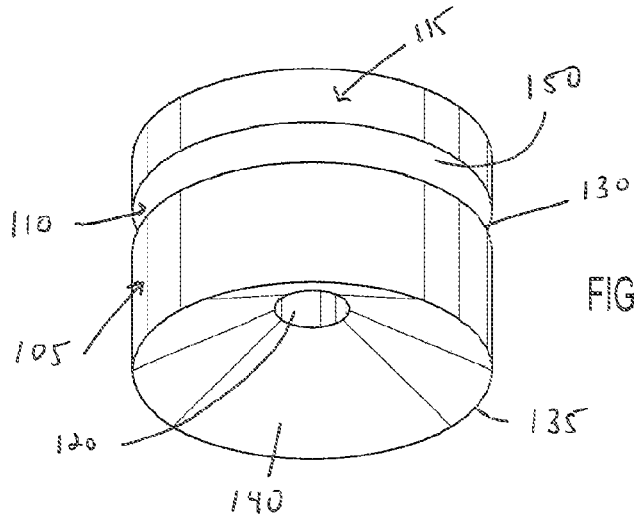
Figure 1C:
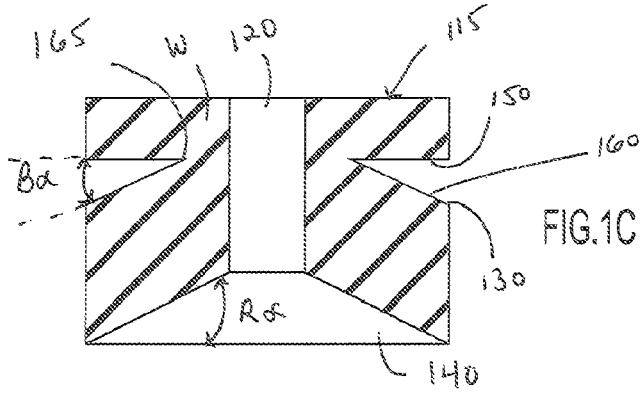
FIG. 1C illustrates a cross sectional view of the support device shown in FIG. 1A.

FIGS. 1A-1C illustrate a support/spacer device in accordance with an embodiment of the present invention. As shown, the support/spacer device 10 (also called a spacer structure) includes a body 100 having axially aligned sections, namely, a bottom section or base 105, an intermediate section or neck 110, and a top section or cap 115. A bore 120 extends longitudinally through the body 100, along the body central axis. The bore 120 defines a channel that permits the passage of the support rod of a cymbal stand therethrough.

The base 105 may possess any shape and dimensions suitable for its described purpose. In the embodiment illustrated, the base 105 possesses a generally cylindrical shape defining a generally annular upper base edge 130 and a generally annular lower base edge 135. The upper base edge 130 is axially spaced from the lower annular base edge 135 by the axial length of the base 105. The base 120 further includes a lower base surface 140 that defines the bottom surface of the device 10. In an embodiment, the lower base surface 140 is cupped, i.e., the lower base surface is recessed into the body 100. By way of example, the lower base surface 140 is recessed in an axially symmetrical manner to define a generally concave surface. The angle of the recess is not particularly limited. By way of example, the recess angle $R\alpha$ of the lower base surface 140 may be approximately 1-100°, e.g., approximately 5°-95° and, in particular, approximately 12-70° (e.g., about 22-24°). It should be understood, however, that the lower base surface 140 may possess any contour suitable for its described purpose (i.e., suitable to achieve results consistent with the operation of the spacer as described herein). By way of example, the lower base surface 140 may define a generally flat surface, a generally convex surface, a generally frustoconical surface, a generally polygonal surface, etc.

The cap 115 may possess any shape suitable for its described purpose. In the illustrated embodiment, the cap 115 is in the form of a circular plate or disk having a continuous circumference. The cap 115 defines a first or top (cymbal facing) surface 145 and a second or bottom (base facing) surface 150. The cap top surface 145 defines the support surface that contacts/engages the cymbal, engages another support/spacer device 10 (when stacked), or engages a connector device such as a cymbal grommet. The surfaces 145, 150 may be generally planar to enable, e.g., secure contact between the top surface 145 and the cymbal, as well as to enable stacking of devices 10 on each other. It should be understood, however, that, in other embodiments, the cap surfaces 145, 150 may be generally concave or generally convex.

The cap 115 may possess any dimensions suitable for its described purpose. By way of example, the cap 115 may possess a thickness of about 1.5 mm (1/16 of an inch) to about 19 mm (3/4 of an inch), e.g., about 6 mm (1/4 of an inch) thick.

The cap 115 is resiliently flexible, i.e., the cap 115 is configured to move or flex when a predetermined amount of force is applied to the cap. As discussed in greater detail below, the cap 115 is configured such that it starts in a first (normal) or unflexed position, but flexes downward (toward the base 105) to a second or flexed position.

The neck 110 is disposed along the body 100 at an axially intermediate position between the base 105 and the cap 115. In the illustrated embodiment, the neck 110 possesses a generally a generally frustoconical shape, with the wide portion of the cone defined by the upper edge 130 of the base 105, and the narrow end terminating at cap bottom surface 150. With this configuration, the neck 110 defines a cut-out portion or gap 155 in the body 100 that permits movement of the cap 115 towards the base 105. Specifically, the neck surface 160 and the cap bottom surface 150 cooperate to form a bevel angle Bα intersecting at an annular edge 165 located concentrically about and radially spaced from the axial bore 115 at a location radially inward of the circumferential periphery of the body 100. The annular edge effective defines a wall W surrounding the bore having a predetermined thickness. In the embodiment illustrated, the bevel angle Bα defines an annular, wedge-shaped gap disposed between the base 105 and the cap 115.

By way of specific example, the gap 155 (measured from the top of the gap to the bottom of the gap) can range from about 1.5 mm (1/16 of an inch) to about 24 mm (15/16 of an inch), depending on percussionist preferences. The depth of the gap 155 can range from as about 6 mm (1/4 of an inch) extending into the body 100 to about 3 mm (1/8 of an inch) away from the bore 120. This will allow for a wall W around the bore 120, leaving a wall thickness of about 3 mm (1/8 of an inch). The standard size of the groove depth in the preferred embodiment is about 9.5 mm (3/8 of an inch). These sizes, however, could be impacted if larger sizes were requested or for specialty uses.

The measurement of the bevel angle Bα may range from approximately 1° to 100° (e.g., about 5° to about 95°) and, in particular, may range from approximately 12° to approximately 70° (e.g., about 22° to about 24°).

The body 100 of the support/spacer device 10 and its sections 105, 110, 115 may be individually or collectively formed of any material suitable for its described purpose. The material forming the cap 115 should be selected such that the cap maintains its shape when unstressed but be sufficiently resiliently flexible to permit the overhanging portion of the cap 115 to flex downward into the gap 155 (and toward the surface 160 of the neck 110) and then return to its normal position in which it is oriented generally horizontally (i.e., generally perpendicular to the bore axis). In an embodiment, the body 100 is formed of moldable material such as plastic, urethane, or rubber. The degree of flexure can be adjusted to suit the requirements of a percussionist, and the material and dimensions can be selected accordingly.

In a preferred embodiment, the body 100 is formed of cast thermoset polyurethane having a durometer (i.e., hardness) as measured on the Shore A or D scale in the range of 55 to 75, most preferably 65. It will be understood, however, that plastic, urethane, or rubber materials of different hardness can be used for each section. For example, the base 105, which provides support and is not necessarily required to flex, as well as the neck 110, may be formed of harder material than that forming the resiliently flexible cap 115. The body 100, moreover, may possess a unitary structure, i.e., the body 100 may be a single molded piece.

The body 100 and its sections (the base 105, the neck 110, the cap 115, and the bore 120) may each individually or collectively possess any dimensions suitable for each of their described purposes. For example, in the embodiment shown FIGS. 1A and 1B, the base 105 is axially longer than the neck 110 and the cap 115. In other embodiments, this may not be the case. Also, while the base 105 and the cap 115 are shown to possess the same outside diameter, in other embodiments, the sections may possess differing diameters. The bore 120, moreover, may possess a constant diameter or may possess a varying diameter. In addition, the bore 120 may include a counter bore to allow for support sleeves to be inserted. The bore 120, moreover, may be textures (e.g., serrated) to improve gripping ability, or may possess varying shapes such as round, square, triangle, etc.

By way of specific example, the axial length of the body 100 may be approximately 25 mm (1 inch), with the axial length of the base 105 equaling approximately 14 mm (9/16 of an inch), the axial length of neck 110 may equal approximately 3 mm (1/8 of an inch), and the axial length of the cap 115 equaling approximately 6 mm (1/4 of an inch). In addition, the outside diameter of the base 105 and the cap 115 may equal approximately 38 mm (1½ inches), the diameter of the bore 120 may equal approximately 8 mm (5/16 of an inch), the diameter of annular edge 165 may equal approximately 22 mm (7/8 of an inch), and the bevel angle Bα may be approximately 22°-24°.

Figure 2A:
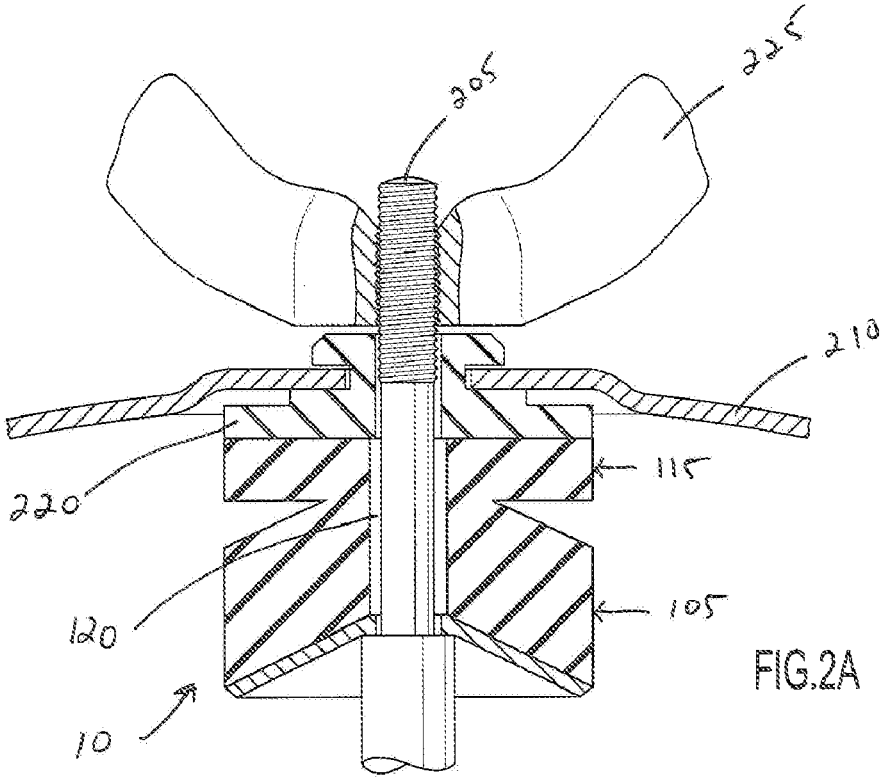
FIG. 2A illustrates the support device of FIG. 1A mounted on a support pole and further including a connector device, showing the support and connector devices in cross section.
Figure 2B:
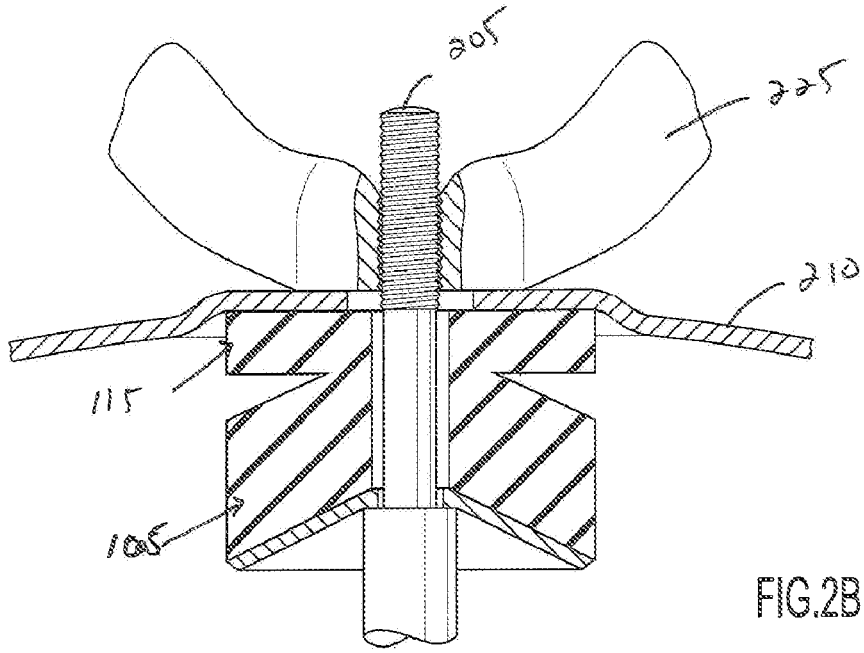
FIG. 2B illustrates the support device of FIG. 1A mounted on a support, showing the support device in cross section.

Referring the FIGS. 2A and 2B, the device 10 is mounted onto the support rod 205 of a cymbal stand by extending the rod through the central bore 120 of the device body 100. Once the device 10 is secured to the rod 205, the cymbal 210 is mounted on the rod. In one arrangement (FIG. 2A), the cymbal 210 may be utilized with a connector device such as a mounting grommet 220, which is inserted through the cymbal's central aperture. By way of example, the mounting grommet 220 may be of the type disclosed in U.S. Pat. No. 7,915,507 (Onheiser), the disclosure of which is incorporated herein by reference in its entirety. In another arrangement (FIG. 2B), the device 10 is utilized without a mounting grommet 220. The cymbal 210 is then secured to the support rod 205 by a fastener 225 (such as wing nut) that engages the threaded upper section of the rod. The wing nut 225 is typically tightened to a degree that is a function of the preference of the percussionist. The height of the cymbal 210 when mounted on the stand is also dependent on percussionist preferences, and the device 10 can be designed with different axial lengths to provide a choice of vertical cymbal position.

Figure 3:
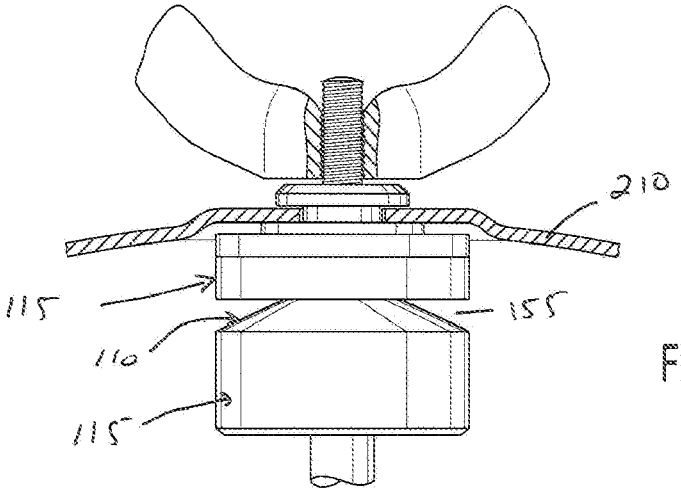
FIGS. 3-5 illustrate the operation of the support device of FIG. 1A.
Figure 4:
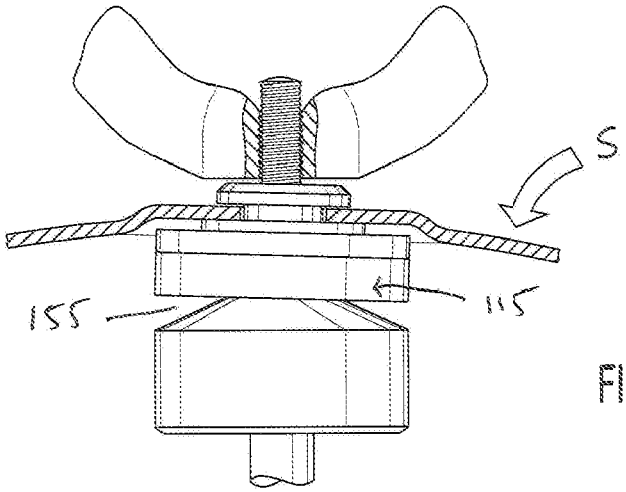
Figure 5:
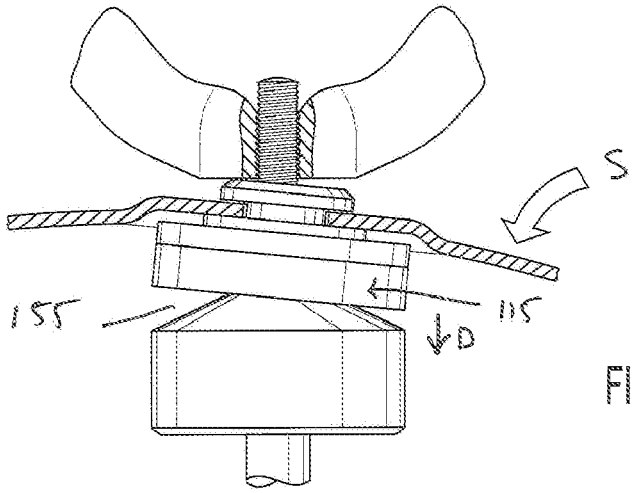

Operation of the support/spaced device 10 is explained with reference to FIGS. 3-5. Referring first to FIG. 3, the device 10 and the cymbal 210 are mounted to a support rod 205 as described above, with the device 10 beginning in it s normal, unflexed position, in which the plane including the cap 115 is oriented generally orthogonal to the rod axis (and thus the bore axis). Referring to FIGS. 4 and 5, when a striking force is applied to the cymbal 210 (indicated by arrow S), e.g., during striking by a percussionist, the portion of the cap 115 that is angularly aligned with the force is resiliently deflected downward (indicated by arrow D) entering the gap 155 defined by the neck 110 (i.e., the cap is deflected toward the base 105). The degree of deflection depends on the magnitude of the force, the flexure characteristic of the material used for the cap 115, cap dimensions, and how tightly the cymbal 210 is tightened against the spacer by the fastener 225. Once the striking force is removed, the cap 115 returns to its normal position.

Figure 6A:
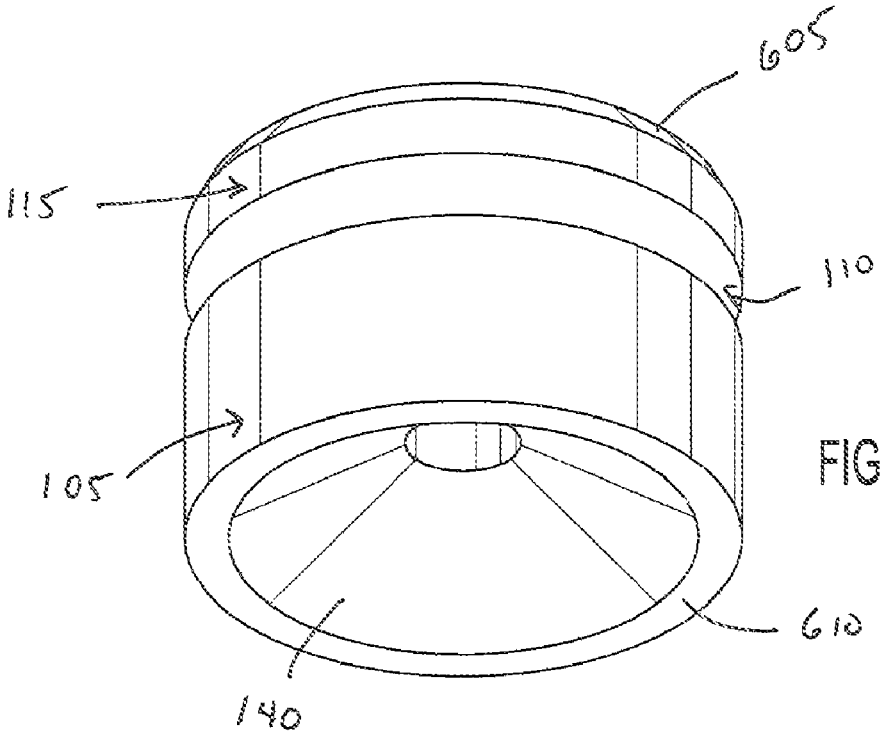
FIG. 6A illustrates a perspective view of a support device in accordance with an embodiment of the present invention.
Figure 6B:
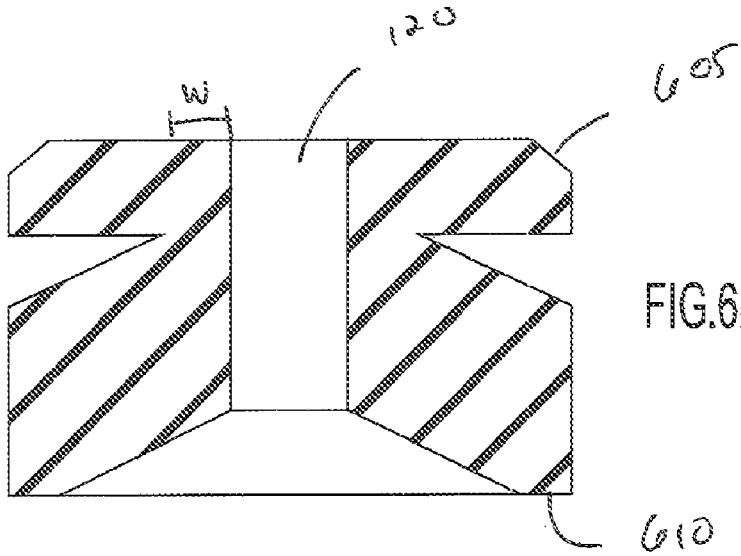
FIG. 6B illustrates a cross sectional view of the support device shown in FIG. 6A.

FIGS. 6A and 6B illustrate a support or spacer device 10 in accordance with another aspect of the invention. As shown, the device 10 includes a structure similar to that described above, including a body 100 having a base 105, an intermediate neck 110, a cap 115, and an axial bore 120. The cap 115 further includes a chamfer 605 disposed along the upper radial edge. The chamfer 605 provides additional clearance to permit the tilt of the cymbal. The base 105 further includes an annular shoulder or landing 610 disposed about the perimetral edge of the lower base surface 140. The landing 610 provides additional contact surface and/or support for devices 10 (e.g., when stacked).

In this configuration, the body 100 may possess an axial length of about 20 mm (13/16 of an inch) and a diameter of about 38 mm (1.50 inches). Specifically, the base 105 possesses an axial height of about 9 mm (0.366 inches), the cap 115 possesses an axial height of about 6 mm (0.25 inches), and the bore 120 possesses a diameter of about 7 mm (0.305 inches). The angle of the intermediate bevel, moreover, is approximately 24°, while the bevel of the base is approximately 24°. The chamfer 605 may define a 45° angle, and may posses a diameter/width of approximately 1 mm (0.3125 inches) to about 6 mm (0.25 inches), e.g., about 3 mm (0.125 inches). The wall W surrounding the bore (before the intersection of the bevel begins) may be approximately 4 mm (0.156 of inches). The shoulder 610 may possess a width of approximately 8 mm (0.31 inches) to about 13 mm (0.5 inches), e.g., about 4 mm (0.156 inches). These dimensions, as well as the chamfer 605 and/or shoulder 610 can be employed in any of the embodiments described herein.

Figure 7A:
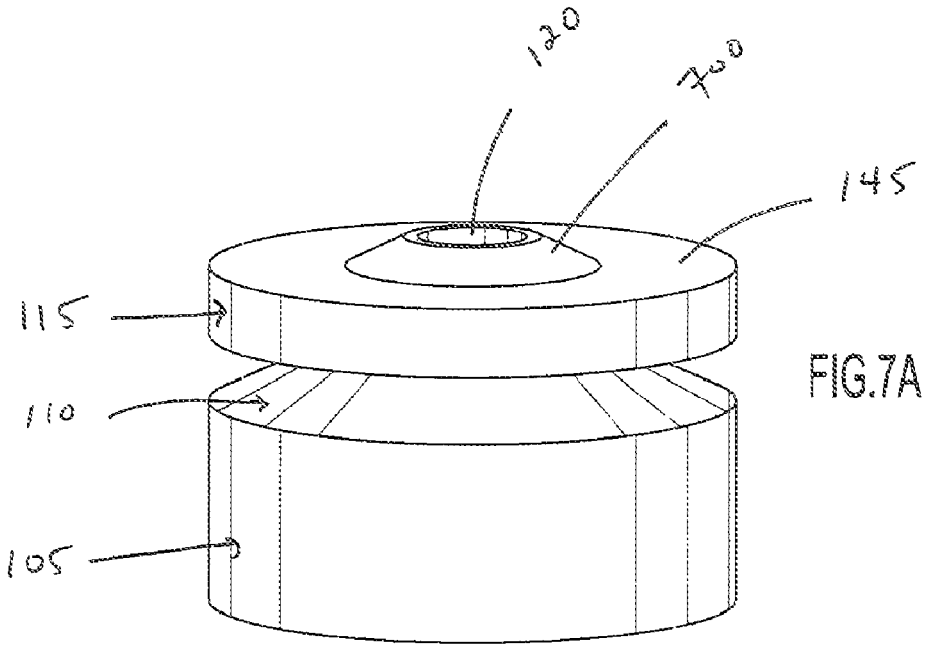
FIG. 7A illustrates a perspective view of a support device in accordance with an embodiment of the present invention.
Figure 7B:
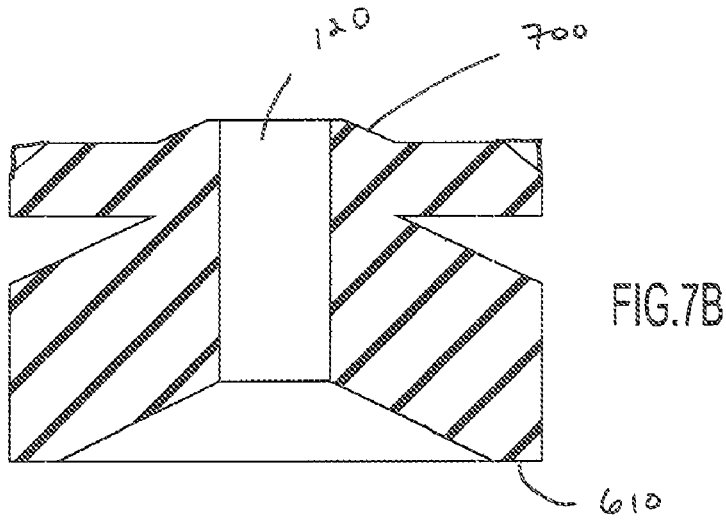
FIG. 7B illustrates a cross sectional view of the support device shown in FIG. 7A.

FIGS. 7A and 7B illustrate an embodiment of the device 10 in which the cap 115 further includes a generally annular protruding portion or protuberance 700 surrounding the bore 120 and extending upward from the cap upper surface 145. The protruding portion 700 provides the cap 115 with a generally convex contour configured to be received by the cymbal's bell region (i.e., the concave portion of the cymbal). As illustrated, the upward extending protuberance 700 is provided at the center of the top surface of the cap 115. The protuberance 705 may be in the form of a segment of a sphere and surrounds that the bore 120 of the spacer. The protuberance 700 can range in either or both width and height from about 3 mm (0.125 inches) to about 16 mm (0.625 inches), and permits central cymbal area, or bell region, surrounding the cymbal central mounting aperture to rest on the protuberance. The protuberance 700 can be employed in any of the embodiments described herein.

By way of specific example, the body 100 of the device including the protuberance 700 may possess an axial length of approximately 20 mm (13/16 of an inch) and a diameter of approximately 38 mm (1.50 inches). Specifically, the base 105 possesses an axial height of approximately 9 mm (0.366 inches), the cap 115 possesses an axial height of approximately 6 mm (0.25 inches-0.15 inches (4 mm) along the outer radial edge and 0.10 inches (2.5 mm) at the height of the protrusion, which further possesses a diameter of approximately 0.75 inches (19 mm)), and the bore 120 possesses a diameter of approximately 8 mm (0.305 inches). The angle of the intermediate bevel, moreover, is approximately 24°, while the bevel of the base is approximately 24°. The wall W surrounding the bore (before the intersection of the bevel begins) may be approximately 4 mm (5/32 of an inch). The shoulder 605 may possess a width of approximately 1 mm (1/32 of an inch) to approximately 13 mm (1/2 of an inch), e.g., about 4 mm (5/32 of an inch).

Figure 8A:
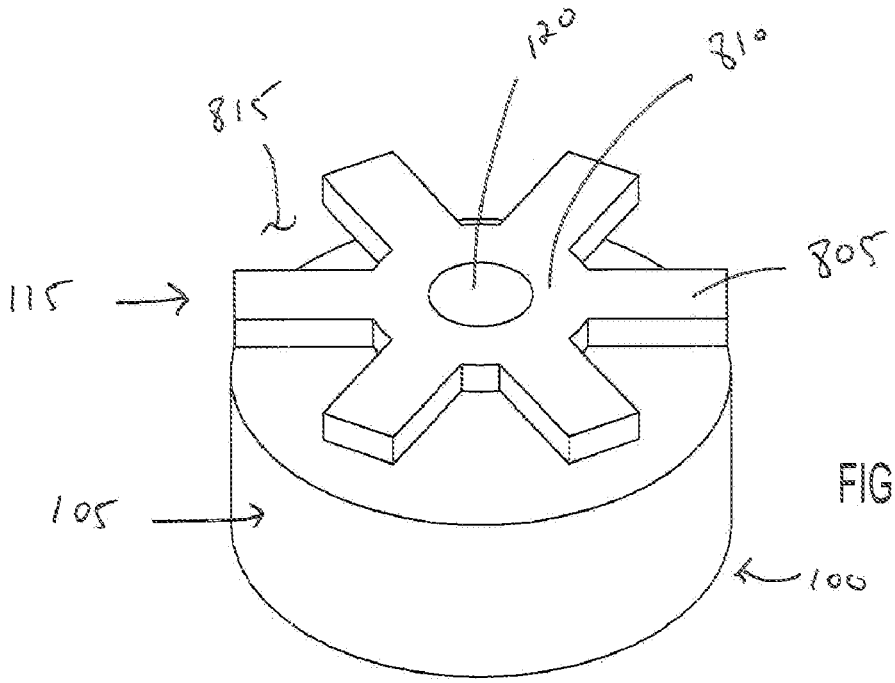
FIGS. 8A and 8B illustrate perspective views of a support device in accordance with an embodiment of the present invention.
Figure 8B:
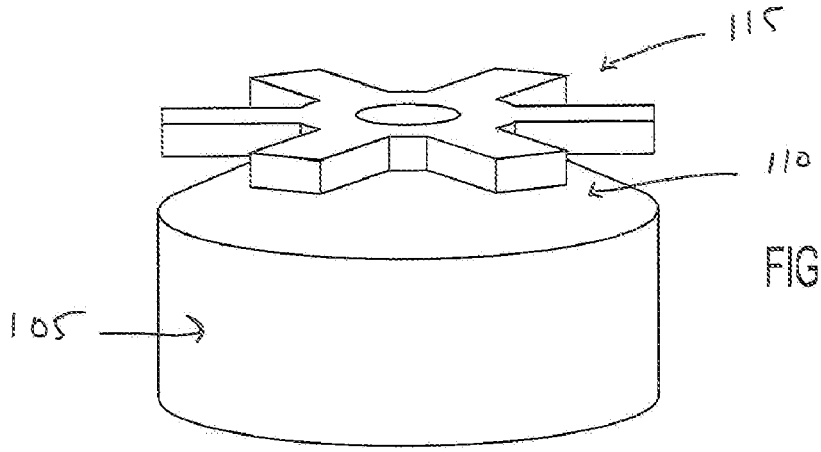

FIGS. 8A and 8B illustrate a support/spacer device 10 in accordance with another aspect of the invention. As shown, the device 10 includes a structure similar to that described above, including a body 100 having a base 105, an intermediate neck 110, a cap 115, and an axial bore 120. The cap 115, however, instead of having a continuous circumference, includes a plurality of angularly spaced tabs or spokes 805. Specifically, the cap 115 in this embodiment has a radially narrow annular area 810 surrounding the central longitudinal bore 120 of the device 10, with the plurality of spoke members 805 extending radially outward from that annular area 810. In the illustrated embodiment, there are six identically configured spoke members 805 equiangularly spaced in sequence by generally pie-shaped gaps 815.

The dimensions of the spokes 805 in a preferred embodiment can range in width from about 4 mm (1/6 of an inch) to about 13 mm (1/2 of an inch), and are configured to reach outward in radial length to the edge of the body diameter. The spokes 805 are radially cantilevered from the annular area 810 to suspend freely at the peripheral edge of the body 100. This cantilever configuration permits the spokes 805 to pivot downward more readily with the supported portion of the cymbal 210 than is the case for the continuous cap 115 of FIG. 1. Each spoke 805 may be of uniform height and width (as illustrated), or the spokes may have variations in these dimensions along their lengths. By way of example, a spoke 805 may possess an outward taper in its depth (or height) as a function of the distance from the annular area 810 to provide a sloping effect. The taper is, for example, from a height of 16 mm (5/8 of an inch) at the annular area 810 to a height of 3 mm (1/8 of an inch) at the body periphery. It will be understood that for some applications the taper may be radially inward rather than radially outward. In addition, although the spokes are shown as having a rectangular transverse cross-section, it will be understood that substantially any cross-sectional configuration (round, polygonal, U-shaped, etc.) may be used. By way of specific example, the radial length of central annular area 810 typically can range from about 3 mm (1/8 of an inch) to about 16 mm (5/8 of an inch) surrounding the longitudinal bore 120. The spokes 805 and optional outer ring (not illustrated), may range in size from about 1.6 mm (1/16 of an inch) to 16 mm (5/8 of an inch) as the spokes extend integrally between annular area 810 and ring, similar to a wagon wheel design.

With this configuration, the cap 115 possesses less surface area than the top surface 145 of the cap 115 seen in FIG. 1; consequently, the device 10 utilizes less material while providing a stable support surface for the cymbal. It is to be understood that a spoke configuration is not a limiting feature of this aspect of the invention in that material can be removed from any portion of the cap 115 of FIG. 1, whether that portion is radially inward from the periphery of the cap and surrounded on all sides or extends inward from the periphery with an open side at the periphery. In addition, the cap 115 may include any number and configuration of the spokes 805. In other words, any means for reducing the material in the cap 115 is considered to be within the scope of this invention. This feature reduces the area contacting the cymbal, thus minimizing possible damping of the oscillations (i.e., the sound) produced by the cymbal. In another aspect of the invention, the distal ends of the spokes 805 may be joined by annular segments to form an outer ring at the spacer periphery. This ring structure circumferentially encloses the open angularly spaced areas extending entirely through the spacer top section between the spokes.

Figure 9:
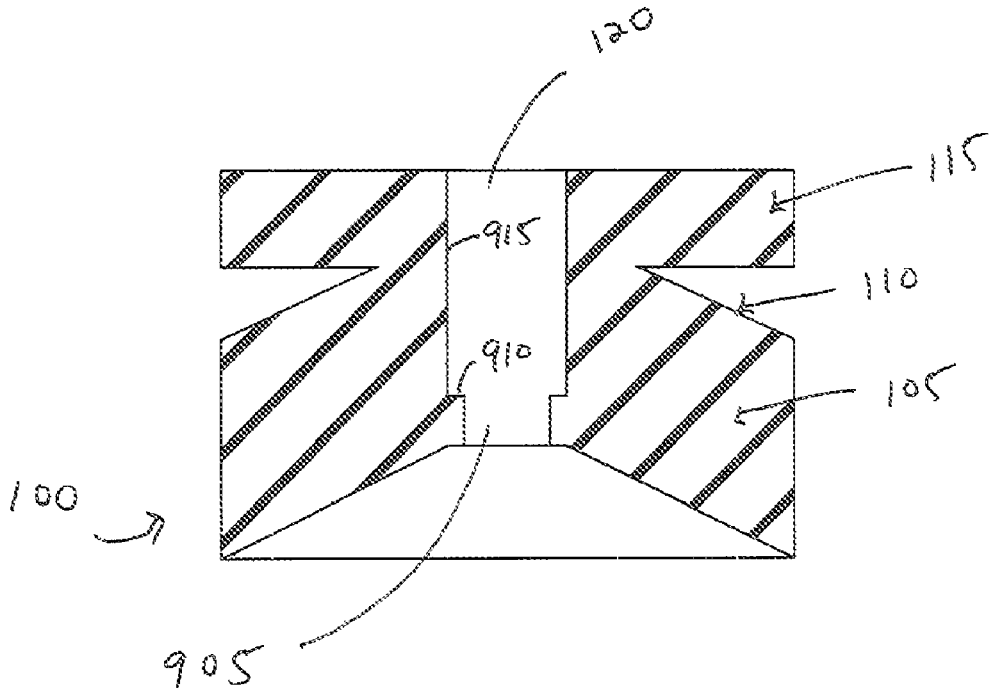
FIG. 9 illustrates a cross sectional view of the support device of FIG. 1A further including a counter bore.

FIG. 9 illustrates a support/spacer device 10 in accordance with another aspect of the invention. As shown, the device 10 includes a structure similar to that described above, including a body 100 having a base 105, an intermediate neck 110, a cap 115, and an axial bore 120. The bore 120, however, is configured with a counter bore 905 creating an annular step 910 in the wall 915 of the bore 120. The counter bore 905 may have a diameter in the range of from about 9 mm (3/8 of an inch) to about 16 mm (5/8 of an inch), and a depth ranging from about 6 mm (1/4 of an inch) to about 22 mm (7/8 of an inch), with the lower portion of the bore typically ranging in size as much as 5 mm (3/16 of an inch) in either direction.

The device 10 may further include a sleeve configured to insert into the body 100 of the support spacer device 10. Specifically, the sleeve may be inserted into the bore 120 such that it is contained completely within or protrudes party from the bore (e.g., protrudes from the cap 115). The sleeve may serve as a connection between the cymbal and the device 10, with the protruding portion extending into the cymbal central aperture. Similarly, the sleeve may connect stacked devices 10 via bore 120. The sleeve may have at its base has a slight bump-out or rib design, which can also be threaded. In addition, both ends of the sleeve can have the same or dissimilar design allowing for the sleeve to latch, anchor, screw or lock into the body 100 of the device 10. The bump out rib design will anchor, screw or lock into this section and help to hold the sleeve in place. This bump-out or rib can range in size from 4 mm (0.16 inches) in diameter to 5 mm (0.1875 inches) in diameter. The sleeve design can be formed of the same material as the body 100, or may be formed of harder or softer material, ranging in a scale of 1 to 100 durometer. The material forming the sleeve includes, but is not limited to polymers, rubber, and plastics and can be used in any of the above-described embodiments. The range of the sleeve size can be 0.100 to 1.500 inches (e.g. 0.112 inches). The sleeve should also have an optional perforated line on the sleeve area at each 0.250 inch so it can be cut off at desired lengths.

With the above described configuration, a support/spacer device 10 is provided that may be placed on the support rod of a cymbal mounting stand to permit the cymbal to be positioned at an optimum height for a percussionist without damping the natural vibrations of the cymbal when struck. The device configuration provides optimal support for the cymbal without adversely affecting cymbal movement and mobility as the cymbal is induced to sway or swing upward and downward when struck. The device 10 of the present invention supports, lifts, raise and enhances the mobility of a musical cymbal's motion as it is placed or mounted on the cymbal stand or other cymbal devices. The device is designed to offer the cymbal more support, a desired height for cymbal positioning, cymbal movement and mobility as the cymbal sways or swings upward and downward as the cymbal is struck when played by the artist.

While the present invention has been described in detail and with reference to specific embodiments thereof, it will be apparent to one skilled in the art that various changes and modifications can be made therein without departing from the spirit and scope thereof. For example, the device 10 and its sections 105, 110, 115 may possess any dimensions and shapes suitable for their described purposes. Thicknesses of the sections could be impacted if larger size spacer were requested or a specialty items such as a cymbal size (larger in diameter) or the cymbal's weight, may require the intermediate section bevel to move downward on the body of the spacer (or if the cymbal is lighter) the bevel may need to move upward on the body of the spacer. This bevel location on the body of the spacer, furthermore, could alter the over-all size of the spacer.

The same above would hold true for the width of the spacer, as a larger cymbal diameter or increased weight of a cymbal, the over-all width of the spacer may need to be increased (these larger diameter cymbals generally are used or found in orchestra bands, etc.). Similar considerations apply to the concave top spacer design as the cymbals are mounted in a tilted position. In this position, the weight distribution may call for two bevels and a wider base, or a single bevel location to be further down from the top of the spacer.

The dimensions of the relief groove or cut (i.e., the gap 155) may vary in shape and size as mentioned earlier and can be applied in different locations on the spacer cylinder or body wall. The groove/gap 155 can be deeper or wider to allow for the needed changes in the spacer width or height as to allow for the varying sizes of cymbals, cymbal stands, or other hardware devices on the market.

The range of the diameter of the bore 120 can be as small as 1/16 inch up to 3/4 inch. A 5/16 inch bore fits cymbal mounting post diameters of 6 mm and 8 mm, but the bore diameter can be larger to fit sleeves that may be used on posts, and provide the capability to manufacture the spacer to meet these needs.

The base 105 and cap 115 sections may further include relief cuts or groves molded or grinned into the top, bottom or beveled surfaces ranging from 0.16 inches to 0.1875 inches. These relief cuts can run in multiple directions such as circular, horizontal, vertical, zigzagged or in patterns. The surfaces of the support/spacer and/or its sections 105, 110, 115 may meet may the same or different. In addition, the surfaces can be individually or collectively manufactured to be smooth or textured.

The various configurations of the support spacer device 10 may possess variable durometers in materials to accommodate for the differences in cymbal weights, sizes or thickness of a cymbals or cymbal stand mounting variations. The entire device 10, or its top 115, intermediate 110, or base 105 sections of the device can have varying durometers, from a range of 1 to 100. By way of example, the top section 115 of the spacer may possess a 80 durometer and the intermediate 110 and/or bottom 105 sections may possess a 65 to 75 durometer. The support/spacer can have varying harnesses or softness with-in its concept as to fully support a cymbal.

The above described spacer configurations and the combinations are designed to support varying types of cymbals, cymbal stands, cymbal accessories or hardware. These would include such things as brass, steel, plastic, wood, synthetic, alloys or other metals or cymbal materials positioned on cymbal stands and other cymbal supporting devices better known as cymbal supporting systems, cymbal stands or cymbal mounting devices. The spacer is a one piece monolithic product made of a urethane base, and can be made of other materials such as rubber, plastic, synthetic or other commonly found materials in the market place.

The support spacer device can have various body dimensions and can have various sectional dimensions. For example, the cap 115, neck 110, or base 115 sections can be made in different sizes, with the cap possessing a greater width than the base 105 or neck 110 can be interchangeable in sizes in many different combinations within the various embodiments. The device 10 can be installed on a support rod either upright as shown in the embodiments of the spacer drawings, or the spacer can be used and applied upside down or turned over. The varieties of monolithic designs sleeves, elevation changes or counter bore etc, shown in the embodiment of the drawings and shown in the different designs of the spacer details too, can be added to the top section or bottom section of the spacer to allow for a variety of spacer design combinations.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

What is claimed is:

1. A cymbal support device for a cymbal including a central aperture, the cymbal support comprising a body having a central longitudinal axis, the body including:

a base section having a base outside diameter larger than the cymbal central aperture diameter;

a cap section formed of resiliently flexible material having an unflexed configuration, the cap possessing a cap outside diameter larger than the cymbal central aperture diameter; and a neck section extending from and between the base and cap sections, the neck section having a cut-out area with a predetermined bevel angle, wherein the cap section is resiliently flexible such that the cap section moves with cymbal movement, moving from a first cap position to a second cap position when the cymbal moves from a first cymbal position to a second cymbal position.

2. The cymbal support of claim 1, wherein the cap section moves to at least one flexed position to permit at least a portion of the cap section to be forcibly deflected toward the base section and return to its unflexed configuration thereby permitting cymbal tilt and wobble.

3. The cymbal support of claim 1, wherein the base section possesses a greater hardness than said cap portion.

4. The cymbal support of claim 1, wherein the neck portion includes a frusto-conical periphery portion that diverges in a direction toward the base portion.

5. The cymbal support of claim 1 wherein said bore has a substantially constant diameter throughout its entire length.

6. The cymbal support of claim 1, wherein the body comprises a unitary structure.

7. The cymbal support of claim 1, wherein each of the base section and the cap section are circumferentially continuous.

8. The cymbal support of claim 1, wherein a central longitudinal bore is defined to extend lengthwise along said central longitudinal axis through the entireties of the base, neck, and cap sections such that the bore is continuously circumferentially enclosed throughout its entire length.

9. The cymbal support of claim 1, wherein the cap section enters the cut-out area of the neck in the flexed configuration.

10. A method of supporting a cymbal having a central aperture on a support rod extending axially on a conventional cymbal support stand, said method comprising:

(a) positioning a cymbal support on the support rod, the cymbal support comprising:

a base section having a base outside diameter larger than the cymbal central aperture diameter;

a cap section formed of resiliently flexible material having an unflexed configuration, the cap possessing a cap outside diameter larger than the cymbal central aperture diameter; and a neck section extending from and between the base and cap sections, the neck section having a cut-out area with a predetermined bevel angle, wherein said cap section is resiliently flexible to at least one flexed configuration to permit at least a portion of the cap section to be forcibly deflected toward the base section and return to its unflexed configuration thereby permitting cymbal tilt and wobble; and (b) positioning a cymbal adjacent the cap section of the cymbal support such that movement of the cymbal results in the movement of the cap section.

* * * * *